US009608351B2

(12) United States Patent
Horning et al.

(10) Patent No.: US 9,608,351 B2
(45) Date of Patent: Mar. 28, 2017

(54) SELF-SECURED ELECTRICAL CONNECTOR

(71) Applicant: Tyco Electronics Corporation, Berwyn, PA (US)

(72) Inventors: Michael James Horning, Lancaster, PA (US); Wayne Samuel Davis, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/749,741

(22) Filed: Jun. 25, 2015

(65) Prior Publication Data

US 2016/0380371 A1 Dec. 29, 2016

(51) Int. Cl.
*H01R 24/00* (2011.01)
*H01R 12/73* (2011.01)

(52) U.S. Cl.
CPC ..... *H01R 12/73* (2013.01)

(58) Field of Classification Search
CPC .... H01R 12/73; H01R 12/52; H01R 13/6471; H01R 12/71; H01R 13/748
USPC ..... 439/629
See application file for complete search history.

(56) References Cited

U.S. PATENT DOCUMENTS 4,781,628 A * 11/1988 Detter ..... H01R 13/432 439/748
7,798,852 B2 * 9/2010 Laurx ..... H01R 13/6471 439/607.08
8,137,138 B2 * 3/2012 Dowhower ..... H01R 12/52 439/626
2011/0092103 A1 * 4/2011 Dowhower ..... H01R 12/52 439/629
2015/0024635 A1 * 1/2015 McClellan ..... H01R 12/71 439/629

* cited by examiner

*Primary Examiner* — Jean F Duverne

(57) ABSTRACT

An electrical connector includes a housing stack and plural conductors. The housing stack includes a front housing and a rear housing. The rear housing is disposed rearward of the front housing. The housing stack defines plural cavities that extend continuously through the front housing and the rear housing. The front housing includes a forward-facing shoulder within at least some of the cavities. The rear housing includes a rear-facing shoulder associated with the cavities that include the forward-facing shoulder. The conductors are disposed in the cavities of the housing stack. At least some of the conductors have a first projecting feature that engages the forward-facing shoulder in the corresponding cavity and a second projecting feature that engages the rear-facing shoulder to secure the front housing to the rear housing.

20 Claims, 6 Drawing Sheets

SELF-SECURED ELECTRICAL CONNECTOR

BACKGROUND OF THE INVENTION

The subject matter herein relates generally to electrical connector systems.

Some electrical connector systems utilize mating electrical connectors to interconnect two circuit boards, such as a motherboard and daughter card. In order to vary the mated distances between the two circuit boards, such as due to space constraints in an electronic device, at least one of the mating electrical connectors may include multiple housing members stacked on top of one another between a mounting end and a mating end. The conductors of this stacked electrical connector are terminated to one circuit board and extend through the housing members towards the mating end to engage mating conductors of the mating connector terminated to the other circuit board.

Some known electrical connectors with stacked housing members have structural problems. More specifically, some such electrical connectors do not sufficiently retain the respective conductors within the housing members. The conductors may fall out of the housing members, such as during shipment of the connectors, when mating and unmating the electrical connector relative to a mating connector, and/or when mounting and removing the electrical connector relative to a circuit board. Additionally, some such electrical connectors have issues securing the housing members to one another. The housing members may undesirably separate from one another when unmating the electrical connector from the mating connector and/or when removing the electrical connector from the circuit board to which the connector is mounted. Typically, the housing members include complementary interference features at interfacing surfaces to align and hold adjacent housing members together. The interference features may include protrusions, pegs, or posts that are received in complementary grooves or holes, barbs, and the like. But, such interference features typically have low retention forces that are not able to withstand the forces applied on the housing members that pull the housing members apart from one another. To increase the retention forces, additional fasteners and/or adhesives may be applied at the interfaces, but such measures undesirably increase assembly time, complexity, and costs.

A need remains for reliably securing together multiple housing members of an electrical connector and for reliably retaining electrical conductors within the housing members of the electrical connector.

BRIEF DESCRIPTION OF THE INVENTION

In an embodiment, an electrical connector is provided that includes a housing stack and plural conductors. The housing stack includes a front housing and a rear housing. The front housing defines a mating end of the housing stack. The rear housing defines a mounting end of the housing stack. The rear housing is disposed rearward of the front housing. The housing stack defines plural cavities that extend continuously through the front housing and the rear housing between the mating end and the mounting end. The front housing includes a forward-facing shoulder within at least some of the cavities. The rear housing includes a rear-facing shoulder associated with the cavities that include the forward-facing shoulder. The conductors are disposed in the cavities of the housing stack. At least some of the conductors have a first projecting feature that engages the forward-facing shoulder in the corresponding cavity and a second projecting feature that engages the rear-facing shoulder to secure the front housing to the rear housing.

In another embodiment, an electrical connector is provided that includes a housing stack and plural conductors. The housing stack includes a front housing and a rear housing. The front housing defines a mating end of the housing stack. The rear housing defines a mounting end of the housing stack. The rear housing is disposed rearward of the front housing. The housing stack defines plural cavities that extend continuously through the front housing and the rear housing between the mating end and the mounting end. The rear housing includes a rear-facing shoulder associated with at least some of the cavities. The front housing includes a forward-facing shoulder within the cavities associated with the rear-facing shoulder. The forward-facing shoulder is a catch surface of a protrusion that extends into the corresponding cavity from a side wall of the front housing that defines the cavity. The conductors are disposed in the cavities of the housing stack. At least some of the conductors have a first projecting feature that engages the forward-facing shoulder in the corresponding cavity and a second projecting feature that engages the rear-facing shoulder to secure the front housing to the rear housing. The first projecting feature is a deflectable tab that deflects in response to a biasing force exerted on the deflectable tab by the protrusion as the respective conductor is loaded into the corresponding cavity.

DETAILED DESCRIPTION OF THE INVENTION

Figure 1:
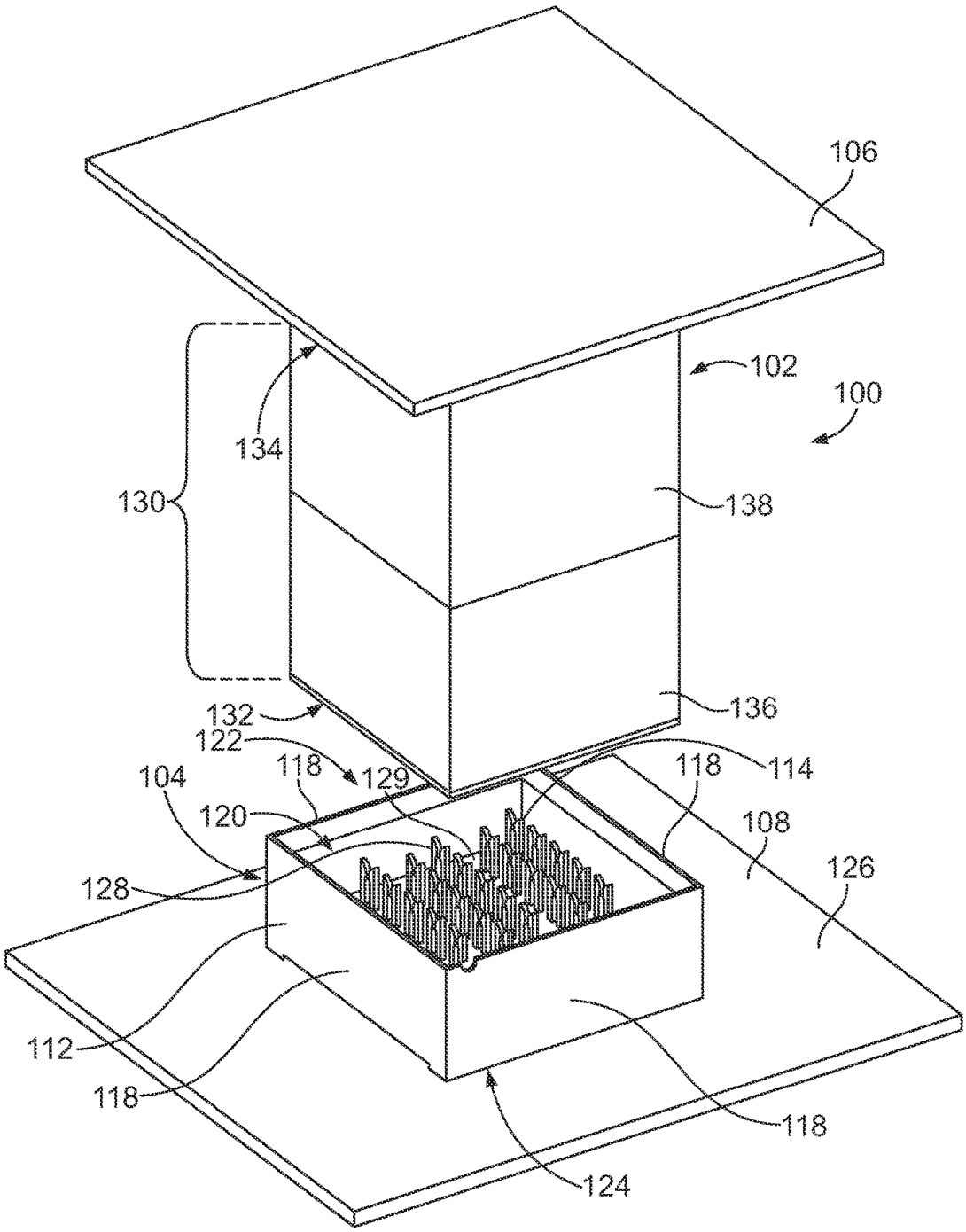
FIG. 1 is a top perspective view of an electrical connector system formed in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. The electrical connector system 100 may be disposed on or in an electrical component, such as a server, a computer, a router, or the like.

In FIG. 1, the first electrical connector 102 and the second electrical connector 104 are shown un-mated, but poised for mating to one another. The first electrical connector 102 and the second electrical connector 104 are configured to be electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the first electrical connector 102 is mounted to the first circuit board 106, and the second electrical connector 104 is mounted to the second circuit board 108. In an embodiment, the first and second circuit boards 106, 108 are oriented parallel to one another when the first and second electrical connectors 102, 104 are mated. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board mounted.

In an exemplary embodiment, the first electrical connector 102 is a receptacle connector, and the second electrical connector 102 is a header connector. The first and second electrical connectors 102, 104 are referred to herein as receptacle connector 102 and header connector 104, respectively. In an embodiment, the receptacle connector 102 is modular in design, having at least two modules or units stacked together to define the height of the receptacle connector 102, which affects the distance between the circuit boards 106, 108 when the connectors 102, 104 are mated. Although not shown in FIG. 1, the header connector 104 in an alternative embodiment may be modular with stackable modules or units to adjust the height of the header connector 104 in addition to, or as an alternative to, the receptacle connector 102 being stackable. Therefore, components of the electrical connectors shown and described in the embodiments herein are not limited to a specific style of connector and may correspond to a receptacle-style connector, a plug-style connector, a header-style connector, or other styles of connectors.

In the illustrated embodiment, the header connector 104 includes a header housing 112 and a plurality of contacts 114. The header housing 112 extends between a mating end 122 and a mounting end 124. The header housing 112 includes multiple outer walls 118 that define a socket 120 therebetween. The socket 120 is open at the mating end 122 of the header housing 112 and is configured to receive a portion of the receptacle connector 102 therein. The header housing 112 may be box-shaped with four outer walls 118. All or at least some of the outer walls 118 may be beveled at the mating end 122 to provide a lead-in section to guide the receptacle connector 102 into the socket 120 during mating. In the illustrated embodiment, the header housing 112 has a fixed height between the mating end 122 and the mounting end 124. The header housing 112 may be formed of at least one dielectric material, such as a plastic or one or more other polymers. The mounting end 124 of the header housing 112 faces, and may also engage, a surface 126 of the second circuit board 108.

The contacts 114 protrude through a base wall 129 of the header housing 112 into the socket 120. The base wall 129 extends between the outer walls 118 and defines a back wall of the socket 120. The contacts 114 may define signal contacts and ground contacts. The contacts 114 are formed of a conductive material, such as copper, a copper alloy, and/or another metal or metal alloy. In the illustrated embodiment, the contacts 114 include flat blades 128 that extend into the socket 120. The contacts 114 also include terminating segments (not shown) that are configured to engage and electrically connect to a corresponding conductor (not shown) of the circuit board 108. The conductors of the circuit board 108 may be electric pads or traces, plated vias, or the like.

The receptacle connector 102 includes a housing stack 130 that extends between a mating end 132 and a mounting end 134. The housing stack 130 is modular and includes at least a front housing 136 and a rear housing 138, which are stackable modules or units. The rear housing 138 is positioned or located rearward of the front housing 136. As used herein, relative or spatial terms such as "top," "bottom," "front," "rear," "left," and "right" are only used to distinguish the referenced elements and do not necessarily require particular positions or orientations in the electrical connector system 100 or in the surrounding environment of the electrical connector system 100.

Figure 2:
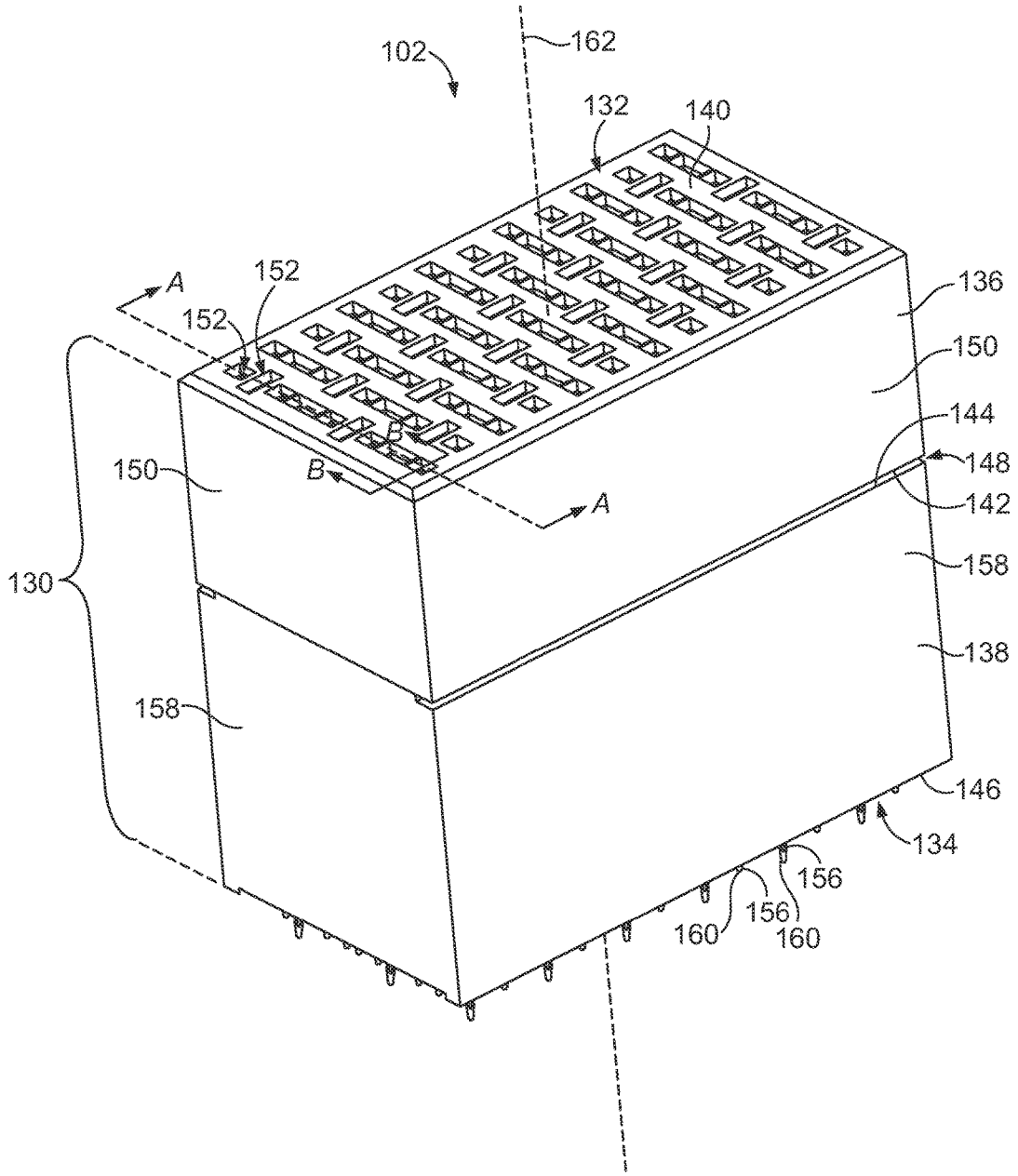
FIG. 2 a perspective view of the electrical connector according to an embodiment.

FIG. 2 is a perspective view of the receptacle connector 102 according to an embodiment. The housing stack 130 extends along a stack axis 162 between the mating end 132 and the mounting end 134. The front housing 136 has a front side 140 and a rear side 142. The front side 140 defines the mating end 132 of the receptacle connector 102. The rear housing 138 extends between a front side 144 and a rear side 146. The rear side 146 defines the mounting end 134 of the receptacle connector 102. In the illustrated embodiment, the front housing 136 and the rear housing 138 engage one another at an interface 148. The interface 148 is defined between the rear side 142 of the front housing 136 and the front side 144 of the rear housing 138.

The front housing 136 in the illustrated embodiment is box-shaped with an oblong (for example, rectangular) cross-sectional area. The front housing 136 includes four outer walls 150 that each extend between the front side 140 and the rear side 142. At least a portion of the front housing 136 that includes the front side 140 is configured to fit within the socket 120 (shown in FIG. 1) of the header connector 104 (FIG. 1). The front side 140 defines openings 152 that lead into cavities 154 (shown in FIG. 3) that extend through the housing stack 130 between the mating end 132 and the mounting end 134. The openings 152 provide access to the cavities 154. During mating, the flat blades 128 (shown in FIG. 1) of the contacts 114 (FIG. 1) are received through the corresponding openings 152 into the cavities 154. Within the cavities 154, the flat blades 128 engage conductors 156 (shown in more detail in FIG. 3) of the receptacle connector 102 to electrically connect the receptacle connector 102 to the header connector 104.

The rear housing 138 in the illustrated embodiment is box-shaped with an oblong (for example, rectangular) cross-sectional area. The rear housing 138 includes four outer walls 158 that each extend between the front side 144 and the rear side 146. Like the front housing 136, the rear housing 138 defines portions of the cavities 154 (shown in FIG. 3) that extend through the housing stack 130 between the mating end 132 and the mounting end 134. The conductors 156 within the cavities 154 include terminating interfaces 160 that extend from the cavities 154 beyond the rear side 146 of the rear housing 138. For example, the terminating interfaces 160 may be eye-of-the-needle pins that are configured to be through-hole mounted to corresponding vias (not shown) in the circuit board 106 (shown in FIG. 1) for electrical termination of the conductors 156 to the circuit board 106. Alternatively, at least some of the terminating interfaces 160 may be bent tails that are configured to be surface mounted, such as through soldering, to conductive pads on the circuit board 106.

The front housing 136 and the rear housing 138 may be composed of dielectric materials, such as one or more plastics or other polymers. The dielectric materials of the front housing 136 may be the same or different than the dielectric materials of the rear housing 138. The front housing 136 and the rear housing 138 in an embodiment are formed by a molding process.

In the illustrated embodiment, the housing stack 130 includes only the front housing 136 and the rear housing 138, such that no other modules or components separate the front housing 136 from the rear housing 138. For example, no components are located at the interface 148 between the front housing 136 and the rear housing 138. In other embodiments, however, the housing stack 130 may include at least one intermediary housing member or spacer member (not shown) that is located between the front housing 136 and the rear housing 138. The spacer member(s) may be used to increase the height of the receptacle connector 102 along the stack axis 162. Optionally, the housing stack 130 may include a ground bracket (not shown) that is located between the front housing 136 and the rear housing 138. The ground bracket may be a conductive frame that is configured to engage ground conductors 166 (shown in FIG. 3) of the conductors 156 in order to electrically common the ground conductors 166 along a ground plane that is located at an intermediate axial location along the housing stack 130.

Figure 3:
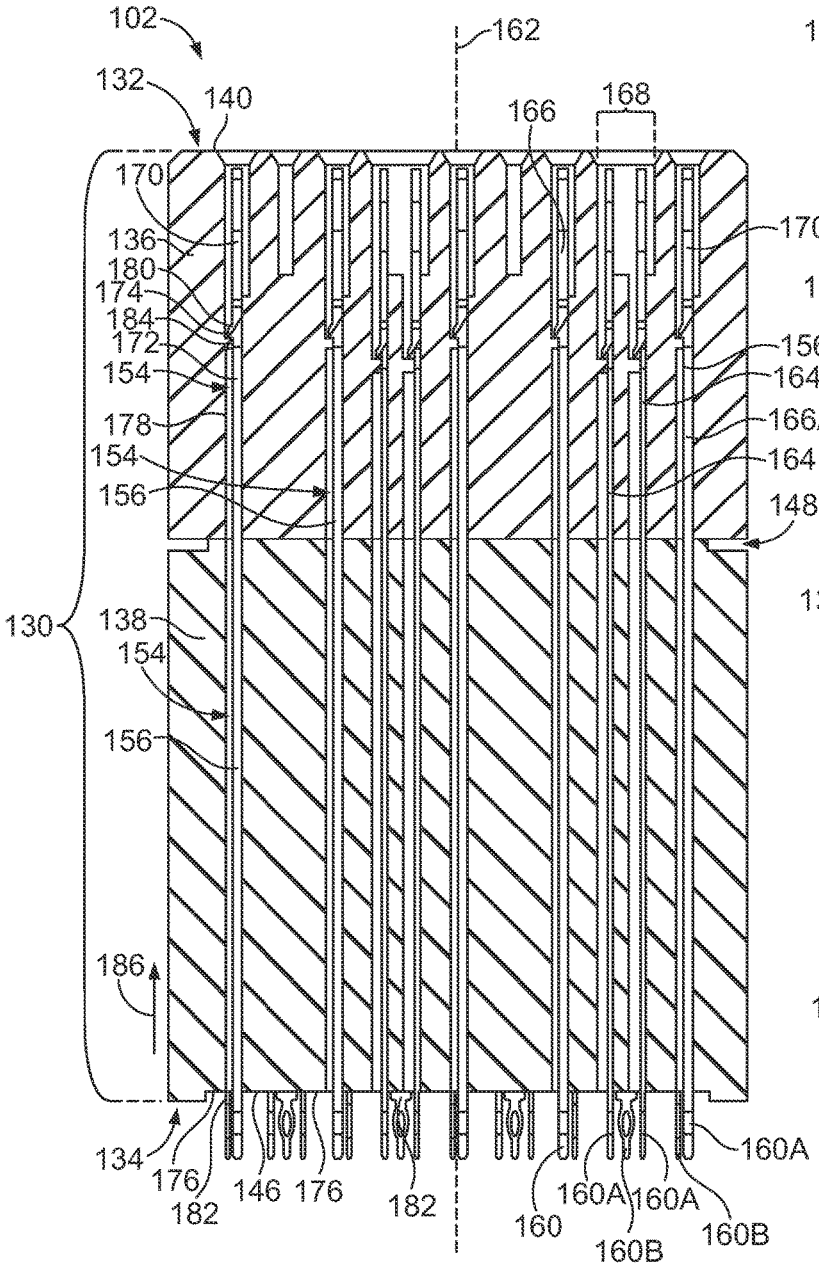
FIG. 3 is a cross-section of the electrical connector along the line A-A shown in FIG. 2 according to an embodiment.
Figure 4:
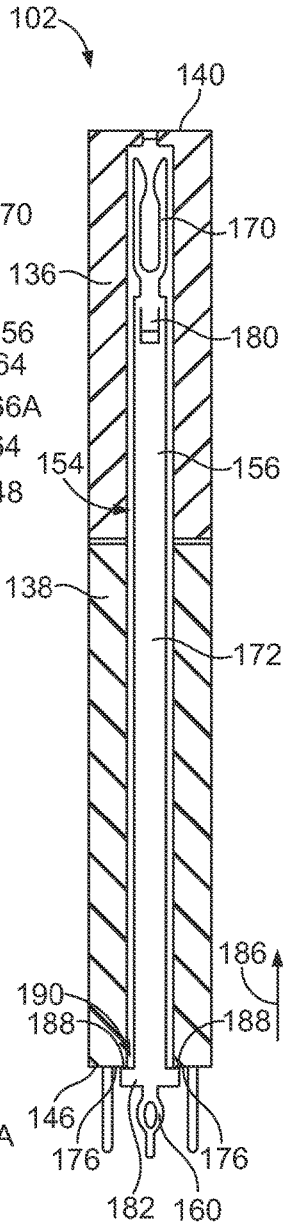
FIG. 4 is a cross-section of a portion of the electrical connector along the line B-B shown in FIG. 2 according to an embodiment.

FIG. 3 is a cross-section of the receptacle connector 102 along the line A-A shown in FIG. 2 according to an embodiment. FIG. 4 is a cross-section of a portion of the receptacle connector 102 along the line B-B shown in FIG. 2 according to an embodiment. Referring to FIG. 3, the housing stack 130 defines plural cavities 154 that extend continuously through the front housing 136 and the rear housing 138 between the mating end 132 and the mounting end 134. For example, each cavity 154 includes a first portion defined by the front housing 136 and a second portion defined by the rear housing 138. The first portion aligns with the second portion such that the cavity 154 extends continuously through the front and rear housings 136, 138.

The receptacle connector 102 includes plural conductors 156 that are disposed in the cavities 154 of the housing stack 130. Each conductor 156 is received in a corresponding one of the cavities 154. The conductors 156 may each extend for at least most of the height of the housing stack 130 between the mating end 132 and the mounting end 134. Therefore, the conductors 156 extend across the interface 148 defined between the front housing 136 and the rear housing 138. The conductors 156 may extend parallel to the stack axis 162. In an embodiment, the conductors 156 are made up of signal conductors 164 and ground conductors 166. The signal conductors 164 are configured to transmit power and/or data signals. The ground conductors 166 are configured to provide an electrical grounding path. In an embodiment, the signal conductors 164 are arranged in a plurality of signal pairs 168 to carry differential signals. The ground conductors 166 are interleaved between the signal pairs 168 to provide shielding between adjacent pairs 166. In the illustrated embodiment, two signal pairs 168 of signal conductors 164 are shown, and each signal pair 168 has a ground conductor 166 located on each side of the respective signal pair 168. The ground conductors 166 may be at least slightly longer than the signal conductors 164 in order to engage the contacts 114 (shown in FIG. 1) of the header connector 104 (FIG. 1) prior to signal conductors 164 engaging the contacts 114, as well as to disengage the contacts 114 subsequent to the signal conductors 164 disengaging the contacts 114.

Optionally, some of the conductors 156 are staggered and/or arranged in different rotational orientations relative to other conductors 156 in the receptacle connector 102. For example, some signal conductors 164 are rotated 90 degrees from other signal conductors 164, as shown by the terminating interfaces 160 that extend from the rear side 146 of the rear housing 138. For example, the terminating interfaces 160A are parts of the conductors 156 through which the cross-section is taken, while the terminating interfaces 160B are parts of conductors located behind the cross-section.

Referring now to FIG. 4, one of the conductors 156 in the housing stack 130 is shown by a cross-section taken along a plane that is orthogonal to the cross-sectional plane shown in FIG. 3. For example, the conductor 156 shown in FIG. 4 may be the ground conductor 166A that is located at the end of the row of conductors 156 shown in FIG. 3. The conductor 156 includes a mating interface 170, the terminating interface 160, and a stem 172 that extends between the mating interface 170 and the terminating interface 160. In an embodiment, the mating interface 170 is a tuning-fork style interface that is configured to engage a corresponding flat blade 128 (shown in FIG. 1) of the header connector 104 (FIG. 1). In other embodiments, the mating interface 170 may be a pin, a socket, or the like, instead of a tuning-fork style interface. The mating interface 170 is located axially within the portion of the cavity 154 that is defined by the front housing 136. Alternatively, the mating interface 170 may extend beyond the front side 140 of the front housing 136. As described above, the terminating interface 160 is an eye-of-the-needle pin that extends beyond or protrudes from the rear side 146 of the rear housing 138 for termination to the circuit board 106 (shown in FIG. 1). The stem 172 of the conductor 156 extends through the remaining length of the corresponding cavity 154 between the mating interface 170 and the terminating interface 160. Optionally, the stem 172 extends linearly. As shown in FIG. 3, the conductors 156 may be oriented parallel to one another and/or parallel to the stack axis 162.

Referring now back to FIG. 3, since the front housing 136 and the rear housing 138 are discrete housing members, the receptacle connector 102 is configured to secure the front and rear housings 136, 138 to one another (as well as to any intervening housing members). In an exemplary embodiment, the conductors 156 are configured to secure the front housing 136 to the rear housing 138. The conductors 156 secure the front and rear housings 136, 138 together to prevent unintentional disassembly of the housing stack 130, such as during shipment, when removing the receptacle connector 102 from the circuit board 106 (shown in FIG. 1), and/or when unmating the receptacle connector 102 from the header connector 104 (FIG. 1) or another mating connector. Furthermore, the housing stack 130 is configured to retain the conductors 156 within the corresponding cavities 154. Thus, the conductors 156 are locked in place within the cavities 154, which prevents the conductors 156 from falling out of the cavities 154 or becoming dislodged within the cavities 154 during shipment, when mounting the receptacle connector 102 on the circuit board 106, and/or when mating the receptacle connector 102 to the header connector 104 or another mating connector.

The front housing 136 includes a forward-facing shoulder 174 within at least some of the cavities 154. The rear housing 138 includes a rear-facing shoulder 176 that is associated with the cavities 154 that include the forward-facing shoulders 174. In the illustrated embodiment, each of the visible cavities 154 includes a forward-facing shoulder 174 associated with a rear-facing shoulder 176. The forward-facing shoulders 174 and the rear-facing shoulders 176 are surfaces that are transverse to the stack axis 162. For example, the shoulders 174, 176 are transverse to side walls 178 of the respective front and rear housings 136, 138 that define the cavities 154. The forward-facing shoulders 174 of the front housing 136 generally face the front side 140 of the front housing 136 (which defines the mating end 132). The rear-facing shoulders 176 of the rear housing 138 generally face the rear side 146 of the rear housing 146 (which defines the mounting end 134).

The conductors 156 have a first projecting feature 180 that engages the forward-facing shoulder 174 in the corresponding cavity 154 and a second projecting feature 182 (shown in more detail in FIG. 4) that engages the rear-facing shoulder 176 associated with the cavity 154. As such, the first and second projecting features 180, 182 allow the respective conductor 156 to engage both the front housing 136 and the rear housing 138. The first projecting feature 180 of a respective conductor 156 engages the forward-facing shoulder 174 at an axial location that is forward of the interface 148 (along the stack axis 162), while the second projecting feature 182 engages the rear-facing shoulder 176 at an axial location that is rearward of the interface 148. In each cavity 154, the forward-facing shoulder 174 and the rear-facing shoulder 176 are disposed axially between the first and second projecting features 180, 182 of the respective conductor 156 within the cavity 154. As such, the first and second projecting features 180, 182 bookend the forward-facing and rear facing shoulders 174, 176, respectively.

The engagement of the first and second projecting features 180, 182 to the forward-facing and rear-facing shoulders 174, 176, respectively, secures the front housing 136 to the rear housing 138. The conductors 156 effectively fasten the front housing 136 to the rear housing 138. Furthermore, such engagement between the projecting features 180, 182 and the shoulders 174, 176 also serves to hold and retain the conductors 156 in position within the corresponding cavities 154. Although all of the conductors 156 visible in the illustrated embodiment include the projecting features 180, 182, some of the conductors 156 of the receptacle connector 102 may not include the projecting features 180, 182.

In an embodiment, the forward-facing shoulder 174 of the front housing 136 is a catch surface of a protrusion 184 that extends into the corresponding cavity 154 from the side wall 178 that defines the cavity 154. The protrusion 184 is an obstruction that reduces the diameter or cross-sectional area of the cavity 154. The first projecting feature 180 may be a deflectable tab that extends from the respective conductor 156. The deflectable tab 180 may extend from the stem 172 of the conductor 156, such as along a portion of the conductor 156 proximate to the mating interface 170. The deflectable tab 180 is configured to deflect around the protrusion 184 as the conductor 156 is loaded into the cavity 154. In an embodiment, the conductors 156 are configured to be loaded into the housing stack 130 in a loading direction 186 from the mounting end 134 towards the mating end 132 (such that the conductors 156 are loaded through the rear housing 138 first and then into the front housing 136). For example, the deflectable tab 180 may deflect or compress in response to a biasing force exerted on the deflectable tab 180 by the protrusion 184 as the conductor 156 is loaded into the cavity 154 past the protrusion 184.

Figure 7A:
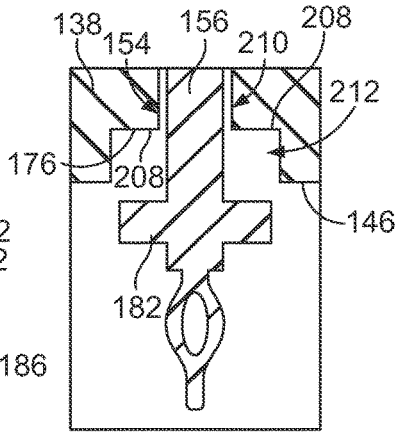
FIGS. 7A-7C illustrate a second segment of one of the conductors that includes a second projecting feature being loaded into a corresponding cavity at different positions relative to a rear-facing shoulder of a rear housing.
Figure 7B:
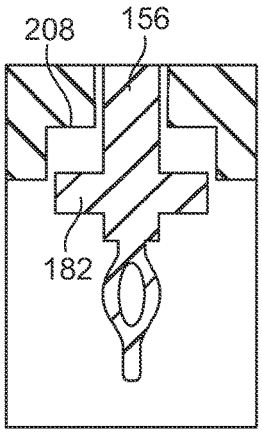
Figure 7C:
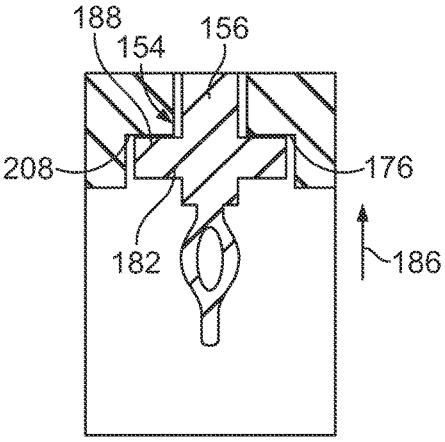

Referring now back to FIG. 4, the second projecting feature 182 is a crossbar that extends from the respective conductor 156. The crossbar 182 may extend from the stem 172 of the conductor 156, such as along a portion of the conductor 156 proximate to the terminating interface 160. An upper edge 188 of the crossbar 182 defines a hard stop surface that engages the rear-facing shoulder 176 that is associated with the corresponding cavity 154. As the conductor 156 is being loaded into the cavity 154, the engagement between the crossbar 182 and the rear-facing shoulder 176 stops movement of the conductor 156 in the loading direction 186. In the illustrated embodiment, the rear-facing shoulder 176 is defined by the rear side 146 of the rear housing 138. For example, the rear-facing shoulder 176 that is associated with a given cavity 154 is a region of the rear side 146 that surrounds the opening 190 to that cavity 154. Although the cavities 154 are sized and shaped to permit insertion of the mating interface 170 and the first projecting feature 180 into the corresponding cavity 154, the crossbar 182 is not permitted into the cavities 154. The crossbar 182 is wider than the opening 190 of the cavity 154, so the upper edge 188 physically contacts and abuts against the rear side 146 of the rear housing 138. In an alternative embodiment, the rear-facing shoulder 176 is a rear-facing ledge 208 within the cavity 154, as shown in FIGS. 7A-7C, instead of the rear side 146 of the rear housing 138.

Figure 5:
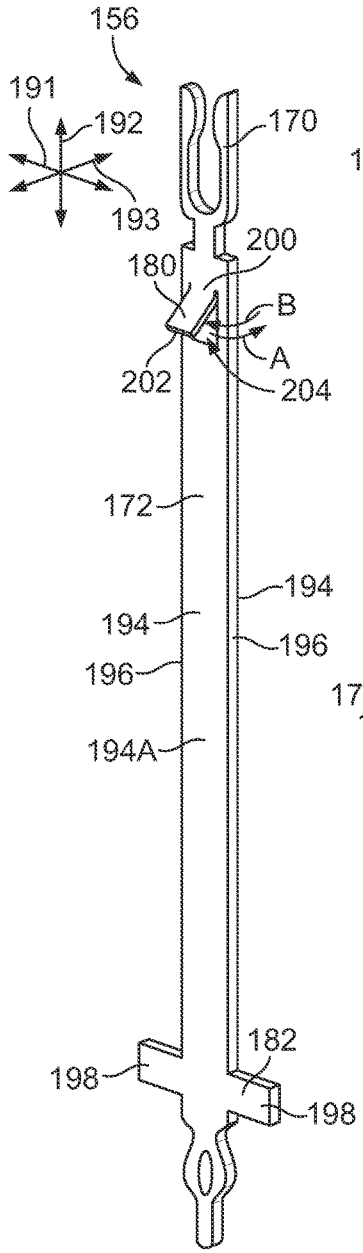
FIG. 5 is a perspective view of one of the conductors of the first electrical connector according to an embodiment.

FIG. 5 is a perspective view of one of the conductors 156 of the receptacle connector 102 (shown in FIG. 3) according to an embodiment. The conductor 156 is oriented with respect to a lateral axis 191, an elevation axis 192, and a depth axis 193. The axes 191-193 are mutually perpendicular. Although the elevation axis 192 appears to extend in a vertical direction parallel to gravity in FIG. 1, it is understood that the axes 191-193 are not required to have any particular orientation with respect to gravity. The conductor 156 is electrically conductive and is formed of a conductive material, such as copper, a copper alloy, silver, or another metal or metal alloy. The conductor 156 may be stamped and formed from a sheet or panel of metal. The conductor 156 may be representative of at least some of the conductors 156 of the receptacle connector 102. For example, the conductor 156 shown in FIG. 5 may be a signal conductor 164 (shown in FIG. 3) or a ground conductor 166 (FIG. 3).

In the illustrated embodiment, the first projecting feature 180 is a deflectable tab, and the second projecting feature 182 is a crossbar. The conductor 156 has two opposing broad sides 194 and two opposing edge sides 196. The edge sides 196 each extend between the two broad sides 194. In an embodiment, the crossbar 182 extends laterally from both edge sides 196 of the conductor 156. For example, the crossbar 182 may include two arms 198 that each extend from one of the edge sides 196. Thus, the crossbar 182 has a T-shape. In an alternative embodiment, the crossbar 182 may extend from only one of the edge sides 196 and include only one arm 198. In an embodiment, the deflectable tab 180 extends from one of the broad sides 194 (for example, a first broad side 194A) of the conductor 156. The deflectable tab 180 may be cantilevered, including a fixed end 200 at the stem 172 and an opposite free end 202 that is spaced apart from the stem 172. The free end 202 is a distal end of the tab 180. In an embodiment, the deflectable tab 180 has an acute angle relative to the first broad side 194A of the stem 172. The deflectable tab 180 is oriented such that the fixed end 200 of the tab 180 is disposed more proximate to the mating interface 170 of the conductor 156 (and to the mating end 132 (shown in FIG. 3) of the housing stack 130 (FIG. 3)), than the proximity of the free end 202 to the mating interface 170 (and to the mating end 132).

In an embodiment, the conductor 156 is generally planar, having a planar stem 172 that is defined along or parallel to the broad sides 194. The planar shape may be attributable to a planar sheet or panel of metal from which the conductor 156 is stamped. In an embodiment, the crossbar 182 extends from the stem 172 along the plane of the stem 172. The deflectable tab 180, on the other hand, extends from the stem 172 out of the plane of the stem 172. The deflectable tab 180 and the crossbar 182 may both be integral to the conductor 156. As the conductor 156 is formed, the deflectable tab 180 may be formed by cutting an outline of the tab 180 in the stem 172 and bending the tab 180 out of the plane of the stem 172. The deflectable tab 180 is bent outward from the first broad side 194A, leaving a window 204 in the stem 172. The deflectable tab 180 is configured to deflect inward towards the first broad side 194A in response to a biasing force exerted on the tab 180. For example, the deflectable tab 180 is in an unbiased position in the illustrated embodiment. When experiencing a biasing force, the deflectable tab 180 may deflect in the direction of the arc A from the unbiased position to a biased position. In the biased position, the free end 202 of the tab 180 is more proximate to the stem 172 than the free end 202 when the tab 180 is in the unbiased position. The tab 180 is configured to resiliently return towards the unbiased position when the biasing force is removed, such that the free end 202 of the tab 180 moves in the direction of arc B away from the stem 172.

In the illustrated embodiment, the deflectable tab 180 is disposed within a width of the stem 172 between the two edge sides 196 of the stem 172. The tab 180 is separated from each of the edge sides 196 by a portion of the stem 172. In other embodiments, however, the tab 180 may extend to one of the edge sides 196.

Figure 6A:
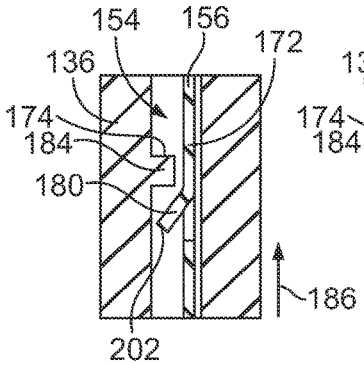
FIGS. 6A-6C illustrate a first segment of one of the conductors that includes a first projecting feature being loaded into a corresponding cavity at different positions relative to a forward-facing shoulder of a front housing.
Figure 6B:
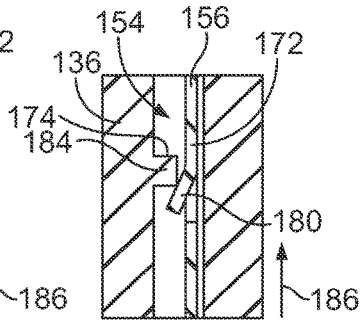
Figure 6C:
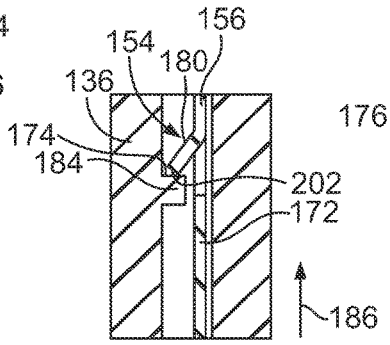

FIGS. 6A-6C illustrate a first segment of one of the conductors 156 that includes the first projecting feature 180 being loaded into the corresponding cavity 154 at different positions relative to the forward-facing shoulder 174 of the front housing 136. In the illustrated embodiments, the first projecting feature 180 is the deflectable tab, and the forward-facing shoulder 174 is a catch surface of the protrusion 184. FIGS. 6A-6C show three successive positions of the deflectable tab 180 relative to the protrusion 184 as the conductor 156 is loaded in the loading direction 186 towards a fully loaded position, which is shown in FIG. 6C.

In FIG. 6A, the deflectable tab 180 is rearward of the protrusion 184 and does not engage the protrusion 184. The deflectable tab 180 is in an unbiased position, extending outward from the stem 172. In FIG. 6B, the conductor 156 has been moved in the loading direction 186 relative to the position shown in FIG. 6A, and the deflectable tab 180 now engages the protrusion 184. The protrusion 184 exerts a biasing force on the tab 180, deflecting the tab 180 towards the stem 172 to a biased position. Optionally, the protrusion 184 may include a ramped or beveled surface (not shown) that is opposite to or adjacent to the forward-facing shoulder 174. The beveled surface of the protrusion 184 may contact the deflectable tab 180 to exert the biasing force on the tab 180. In FIG. 6C, the conductor 156 has been moved in the loading direction 186 relative to the position shown in FIG. 6B, and the conductor 156 is in the fully loaded position relative to the cavity 154. As the distal, free end 202 of the tab 180 moves beyond the forward-facing shoulder 174 of the front housing 136 (for example, the catch surface of the protrusion), the tab 180 resiliently transitions from the biased position shown in FIG. 6B towards the unbiased position of the tab 180. The tab 180 in FIG. 6C extends from the stem 172 along an angle that may be at least approximately the same as the angle of the tab 180 relative to the stem 172 in FIG. 6A. The free end 202 of the tab 180 may engage the forward-facing shoulder 174, which prohibits the conductor 156 from moving in a direction opposite to the loading direction 186 out of the fully loaded position shown in FIG. 6C. For example, the engagement between the tab 180 and the forward-facing shoulder 174 may prevent or at least prohibit the conductor 156 from falling out of the cavity 154 through the opening 190 (shown in FIG. 4) along the rear side 146 (FIG. 4) of the rear housing 138 (FIG. 4) during shipment, as the receptacle connector 102 (shown in FIG. 1) is removed from the circuit board 106 (FIG. 1), and/or as the receptacle connector 102 is mated to the header connector 104.

In an alternative embodiment, the first projecting feature 180 is a protuberance (for example, a barb, lump, knob, or other protrusion) that extends from the stem 172, but is not a deflectable tab. The protrusion 184 of the front housing 136 may be at least partially compressible, such that the protrusion 184 compresses as the conductor 156 is loaded into the cavity 154 to allow the first projecting feature 180 to pass beyond the protrusion 184 to engage the forward-facing shoulder 174. Optionally, the protuberance 180 and the protrusion 184 include complementary ramped or beveled surfaces. As the conductor 156 is moved in the loading direction 186, the beveled surface of the protuberance 180 engages and slides along the beveled surface of the protrusion 184. Once the protuberance 180 moves beyond the forward-facing shoulder 174 of the protrusion 184, a rear-facing catch surface of the protuberance 180 extends over and engages the forward-facing shoulder 174.

FIGS. 7A-7C illustrate a second segment of one of the conductors 156 that includes the second projecting feature 182 being loaded into the corresponding cavity 154 at different positions relative to the rear-facing shoulder 176 of the rear housing 138. In the illustrated embodiments, the second projecting feature 182 is the crossbar. FIGS. 7A-7C show three successive positions of the second projecting feature 182 relative to the rear housing 138 as the conductor 156 is loaded in the loading direction 186 towards a fully loaded position, which is shown in FIG. 7C. The three successive positions may be the same three positions that are shown in FIGS. 6A-6C. For example, FIGS. 6A and 7A may show different segments of the conductor 156 at the same position of the conductor 156 relative to the housing stack 130 (shown in FIG. 3). FIGS. 6B and 7B and FIGS. 6C and 7C may likewise show the different segments of the conductor 156 at the same positions, respectively, relative to the housing stack 130.

In FIGS. 7A-7C, the rear-facing shoulder 176 of the rear housing 138 is a ledge 208 within the cavity 154 that is spaced apart from the rear side 146 of the rear housing 138. Thus, the embodiment illustrated in FIGS. 7A-7C differs from the embodiment shown in FIG. 4, in which the rear-facing shoulder 176 is defined by the rear side 146 of the rear housing 138. The ledge 208 is a stepped surface that divides a narrow region 210 of the cavity 154 from a broad region 212 of the cavity 154. The cavity 154 along the broad region 212 has a greater diameter and/or cross-sectional area than along the narrow region 210. The broad region 212 extends from the ledge 208 towards the rear side 146 of the rear housing 138. In the illustrated embodiment, the broad region 212 extends the full length between the ledge 208 and the rear side 146.

In FIGS. 7A and 7B, the crossbar 182 is spaced apart from the ledge 208 and does not engage the ledge 208. The crossbar 182 is more proximate to the ledge 208 in FIG. 7B than the proximity of the crossbar 182 to the ledge 208 in FIG. 7A as the conductor 156 is closer to the fully loaded position in FIG. 7B than in FIG. 7A. In FIG. 7C, the conductor 156 is in the fully loaded position, and the crossbar 182 is engaged with the ledge 208 such that the upper edge 188 of the crossbar 182 physically contacts and abuts against the ledge 208. The upper edge 188 of the crossbar 182 is a hard stop surface that prohibits the conductor 156 from further advancement into the cavity 154 in the loading direction 186. The crossbar 182 engaging the rear-facing shoulder 176 also prevents or at least prohibits the conductor 156 from falling out of the cavity 154 through the opening 152 (shown in FIG. 2) along the front side 140 (FIG. 2) of the front housing 136 (FIG. 4) during shipment, as the receptacle connector 102 (shown in FIG. 1) is mounted to the circuit board 106 (FIG. 1), and/or as the receptacle connector 102 is unmated from the header connector 104. Although the conductor 156 is described in FIGS. 6C and 7C as having the deflectable tab 180 engaging the forward-facing shoulder 174 and the crossbar 182 engaging the rear-facing shoulder 176 when the conductor 156 is in the fully loaded position, it should be apparent that the invention may be implemented with some clearance between the first and second projecting features 180, 182 and the respective shoulders 174, 176. That is, the conductor 156 need not maintain contact with both shoulders 174, 176 at all times when the conductor 156 is in the fully loaded position. In an embodiment, the first projecting feature 180 of the conductor 156 engages the forward-facing shoulder 174 of the front housing 136 to hold the front housing 136 relative to the rear housing 138, and the second projecting feature 182 of the conductor 156 engages the rear-facing shoulder 176 of the rear housing 138 to hold the rear housing 138 relative to the front housing 136. As a result, the conductor 156 functions to secure the front housing 136 and the rear housing 138 together, which supports the structural integrity of the receptacle connector 102 (shown in FIG. 3).

Figure 8:
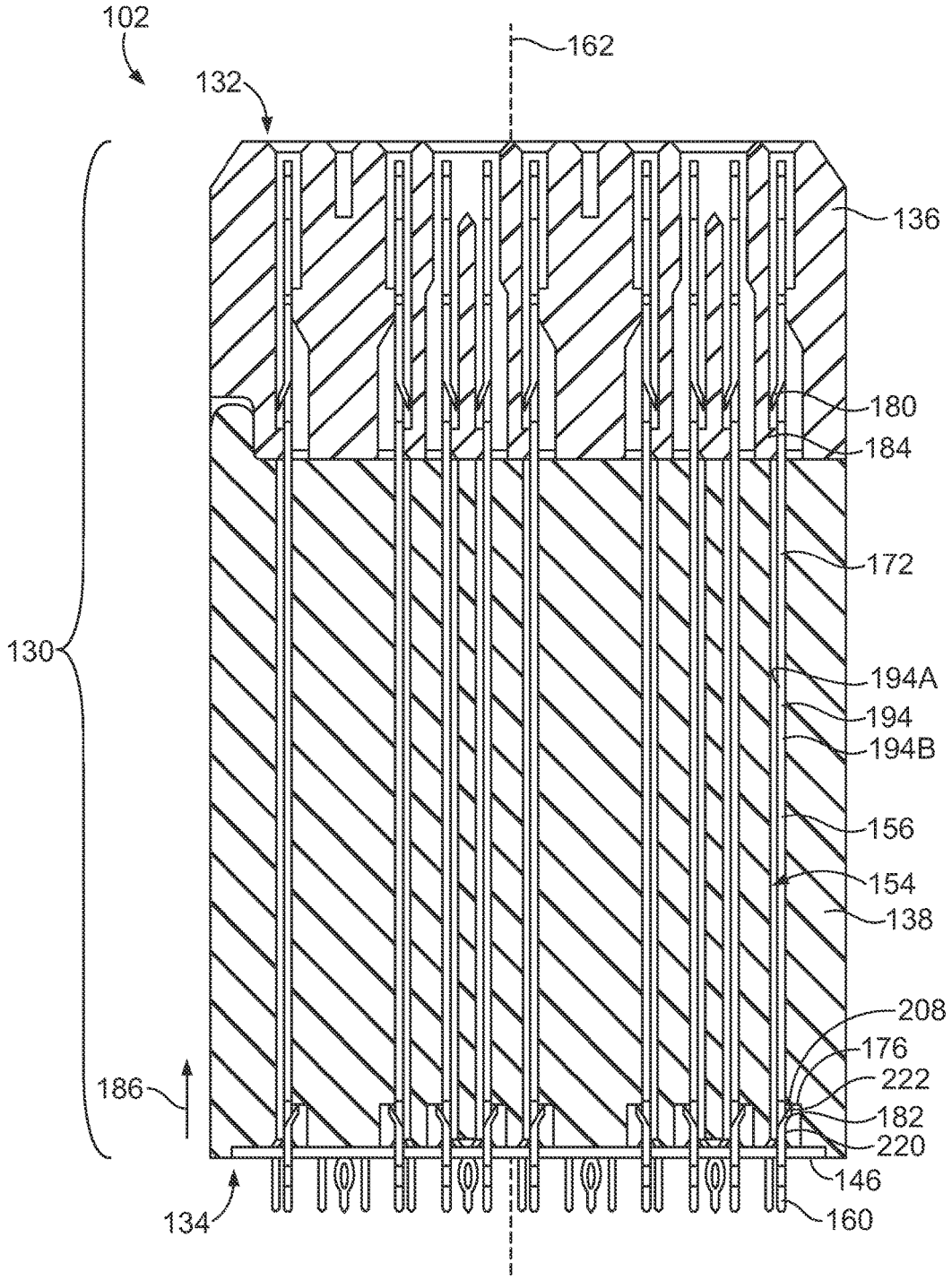
FIG. 8 is a cross-section of the electrical connector along the line A-A shown in FIG. 2 according to an alternative embodiment.

FIG. 8 is a cross-section of the receptacle connector 102 along the line A-A shown in FIG. 2 according to an alternative embodiment. In the illustrated embodiment in FIG. 8, the second projecting feature 182 extends from one of the broad sides 194 of the respective conductor 156. Thus, both the first and second projecting features 180, 182 extend from the broad sides 194. In an embodiment, the first projecting feature 180 extends from the first broad side 194A, while the second projecting feature 182 extends from the second broad side 194B. Thus, the first and second projecting features 180, 182 extend from opposite sides 194 of the conductor 156. Both the first and second projecting features 180, 182 extend out of the plane defined by the planar stem 172 of the conductor 156. The second projecting feature 182 is configured to engage the rear-facing shoulder 176, which is disposed proximate to the second broad side 194B of the conductor 156. Therefore, the first projecting feature 180 does not engage the rear-facing shoulder 176 as the respective conductor 156 is being loaded into the corresponding cavity 154 in the loading direction 186. The first projecting feature 180 is the deflectable tab. As the conductor 156 is being loaded into the cavity 154, the deflectable tab 180 moves beyond the rear-facing shoulder 176 and does not deflect until engaging the protrusion 184 defined by the front housing 136.

In the illustrated embodiment, the second projecting feature 182 is a cantilevered beam. The cantilevered beam 182 is disposed proximate to the terminating interface 160 of the conductor 156. The cantilevered beam 182 includes a fixed end 220 at the stem 172 and an opposite free end 222 that is spaced apart from the stem 172. The free end 222 is a distal end of the beam 182. The cantilevered beam 182 may be formed by shearing or punching the free end 222 of the beam 182 out of the plane of the stem 172. In an embodiment, the cantilevered beam 182 extends at an acute angle relative to the second broad side 194B such that the fixed end 220 is more proximate to the mounting end 134 of the housing stack 130 than the proximity of the free end 222 to the mounting end 134. Put another way, the free end 222 is more proximate to the mating end 132 of the housing stack 130 than the proximity of the fixed end 220 to the mating end 132. The free end 222 of the cantilevered beam 182 defines a hard stop surface that is configured to engage the rear-facing shoulder 176 associated with the corresponding cavity 154. In an embodiment, the cantilevered beam 182 is not configured to deflect upon loading the conductor 156 into the cavity 154, unlike the deflectable tab 180 that defines the first projecting feature 180. In an alternative embodiment, the second projecting feature 182 may be a bump or other protrusion that extends from the broad side 194B, instead of a cantilevered beam.

In the illustrated embodiment, the rear-facing shoulder 186 is defined by the ledge 208 within the cavity 154 that is spaced apart from the rear side 146 of the rear housing 138. In an alternative embodiment, the rear-facing shoulder 186 may be defined by regions of the rear side 146 of the rear housing 138 around the cavities 154, as described with reference to FIG. 4.

Figure 9:
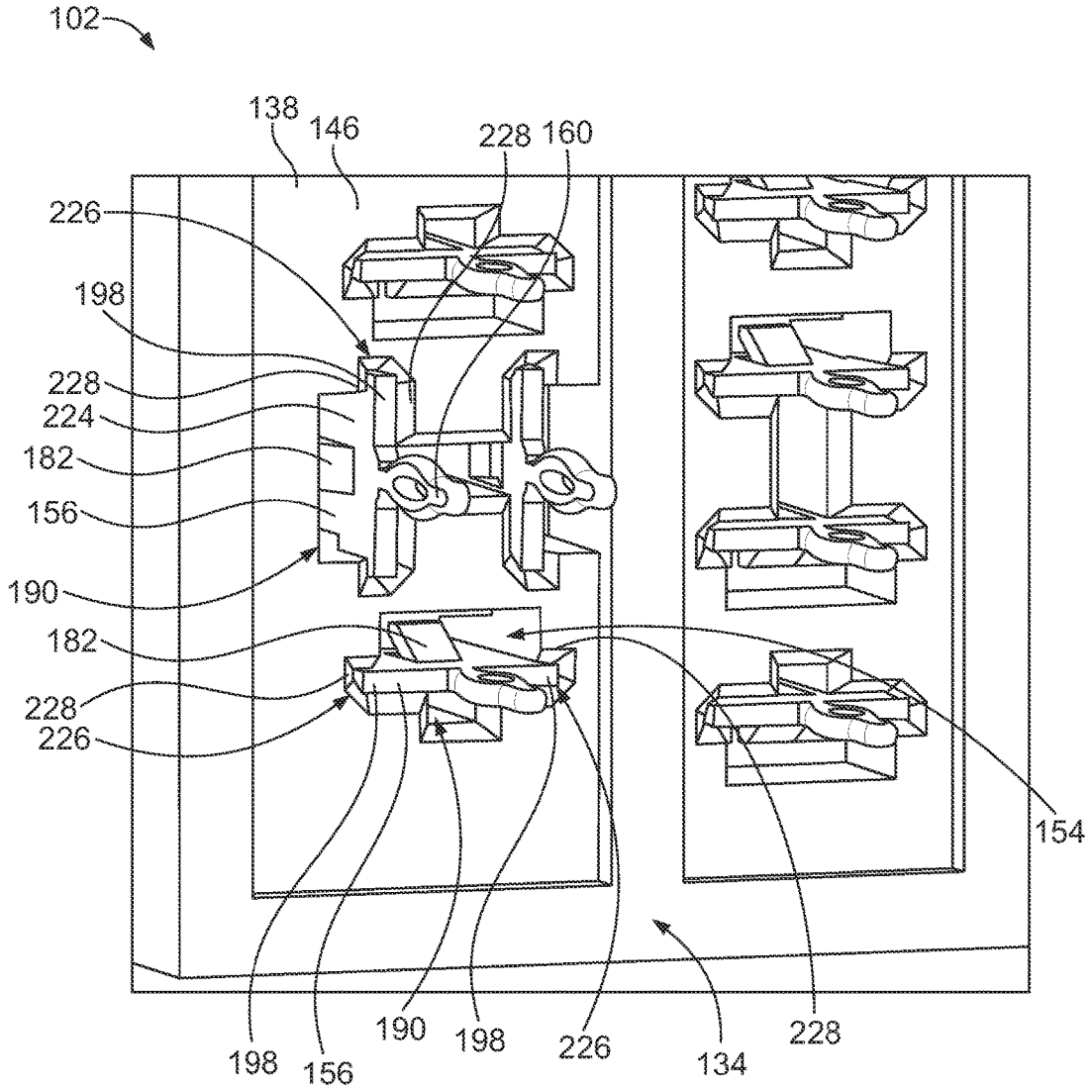
FIG. 9 is a perspective view of a portion of the mounting end of the electrical connector according to the embodiment shown in FIG. 8.

FIG. 9 is a perspective view of a portion of the mounting end 134 of the receptacle connector 102 according to the embodiment shown in FIG. 8. In the illustrated embodiment, the conductors 156 each include a crossbar 224 proximate to the terminating interface 160 in addition to the cantilevered beam 182 that defines the second projecting feature 182. The crossbar 224 may be similar in shape to the crossbar 182 shown in FIG. 5, such that the crossbar 224 extends from the edge sides 196 (shown in FIG. 5) of the stem 172 (FIG. 5) of the respective conductor 156. In the illustrated embodiment, each opening 190 to one of the cavities 154 at the rear side 146 of the rear housing 138 defines slotted recesses 226 that are specifically configured to receive the arms 198 of the crossbar 224 of the respective conductor 156 therein. When the conductor 156 is fully loaded within the cavity 154, the crossbar 224 is disposed within the slotted recesses 226. The walls 228 defining the slotted recesses 226 engage the crossbar 224 to restrict movement of the conductor 156, including rotation and translation, in the plane defined by the lateral and depth axes 191, 193 (shown in FIG. 5). Put another way, engagement between the crossbar 224 and the walls 228 restricts twisting and side-to-side movement of the conductor 156 along a plane perpendicular to the stack axis 162 (shown in FIG. 8).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing stack comprising a front housing and a rear housing, the front housing defining a mating end of the housing stack, the rear housing defining a mounting end of the housing stack, the rear housing disposed rearward of the front housing, the housing stack defining plural cavities that extend continuously through the front housing and the rear housing between the mating end and the mounting end, the front housing including a forward-facing shoulder within at least some of the cavities, the rear housing including a rear-facing shoulder associated with the cavities that include the forward-facing shoulder; and plural conductors disposed in the cavities of the housing stack, at least some of the conductors having a first projecting feature that engages the forward-facing shoulder in the corresponding cavity and a second projecting feature that engages the rear-facing shoulder to secure the front housing to the rear housing.

2. The electrical connector of claim 1, wherein the conductors extend across an interface defined between the front housing and the rear housing, the first projecting feature of a respective conductor engaging the forward-facing shoulder at a location forward of the interface and the second projecting feature of the respective conductor engaging the rearward-facing shoulder at a location rearward of the interface to resist separation of the front housing relative to the rear housing at the interface.

3. The electrical connector of claim 1, wherein the forward-facing shoulder of the front housing is a catch surface of a protrusion that extends into the corresponding cavity from a side wall defining the cavity.

4. The electrical connector of claim 1, wherein the first projecting feature is a deflectable tab that extends from a stem of the respective conductor.

5. The electrical connector of claim 4, wherein the respective conductor is configured to be loaded into the corresponding cavity in a loading direction from the mounting end towards the mating end, the deflectable tab being configured to resiliently transition from a biased position towards an unbiased position as a distal end of the deflectable tab moves in the loading direction beyond the forward-facing shoulder of the front housing.

6. The electrical connector of claim 4, wherein the deflectable tab includes a fixed end at a stem of the respective conductor and a free end that is spaced apart from the stem, the fixed end being more proximate to the mating end of the housing stack than a proximity of the free end to the mating end.

7. The electrical connector of claim 4, wherein the conductors each have two opposing broad sides and two opposing edge sides that extend between the broad sides, the deflectable tab extending from a first broad side of the two broad sides and configured to deflect inward towards the first broad side in response to a biasing force.

8. The electric connector of claim 7, wherein the second projecting feature of each conductor extends from a second broad side of the two broad sides.

9. The electrical connector of claim 1, wherein the conductors have planar stems that extend across an interface defined between the front housing and the rear housing, the first projecting feature of the corresponding conductors extending from the respective stem out of a plane defined by the stem, the second projecting feature extending from the respective stem along the plane of the stem.

10. The electrical connector of claim 1, wherein the housing stack extends along a stack axis between the mating end and the mounting end, the forward-facing shoulder of the front housing and the rear-facing shoulder of the rear housing that are associated with the same cavity being disposed axially between the first and second projecting features of the respective conductor within the cavity such that the first and second projecting features of the respective conductor resist separation of the front housing relative to the rear housing along the stack axis.

11. The electrical connector of claim 1, wherein the conductors each have two opposing broad sides and two opposing edge sides that extend between the broad sides, the second projecting feature being a cantilevered beam that extends from one of the broad sides of the respective conductor, the cantilevered beam extending at an angle relative to the broad sides such that a free end of the cantilevered beam is more proximate to the mating end of the housing stack than a proximity of a fixed end of the cantilevered beam to the mating end, the free end of the cantilevered beam defining a hard stop surface that engages the rear-facing shoulder associated with the corresponding cavity.

12. The electrical connector of claim 1, wherein the conductors each have two opposing broad sides and two opposing edge sides that extend between the broad sides, the second projecting feature being a crossbar that extends from both edge sides of the respective conductor, the crossbar defining a hard stop surface that engages the rear-facing shoulder associated with the corresponding cavity.

13. The electrical connector of claim 1, wherein the rear-facing shoulder is defined by a rear side of the rear housing that defines the mounting end of the housing stack.

14. The electrical connector of claim 1, wherein the rear-facing shoulder of the rear housing is a ledge within the corresponding cavity, the ledge dividing a narrow region of the cavity and a broad region of the cavity, the broad region of the cavity having a greater cross-sectional area than the narrow region of the cavity, the broad region extending from the ledge towards a rear side of the rear housing that defines the mounting end of the housing stack.

15. An electrical connector comprising:

a housing stack comprising a front housing and a rear housing, the front housing defining a mating end of the housing stack, the rear housing defining a mounting end of the housing stack, the rear housing disposed rearward of the front housing, the housing stack defining plural cavities that extend continuously through the front housing and the rear housing between the mating end and the mounting end, the rear housing including a rear-facing shoulder associated with at least some of the cavities, the front housing including a forward-facing shoulder within the cavities associated with the rear-facing shoulder, the forward-facing shoulder being a catch surface of a protrusion that extends into the corresponding cavity from a side wall of the front housing that defines the cavity; and plural conductors disposed in the cavities of the housing stack, at least some of the conductors having a first projecting feature that engages the forward-facing shoulder in the corresponding cavity and a second projecting feature that engages the rear-facing shoulder to secure the front housing to the rear housing, wherein the first projecting feature is a deflectable tab that deflects in response to a biasing force exerted on the deflectable tab by the protrusion as the respective conductor is loaded into the corresponding cavity.

16. The electrical connector of claim 15, wherein the respective conductor is configured to be loaded into the corresponding cavity in a loading direction from the mounting end towards the mating end, the deflectable tab being configured to resiliently transition from a biased position towards an unbiased position as a distal end of the deflectable tab moves in the loading direction beyond the forward-facing shoulder of the protrusion within the cavity.

17. The electrical connector of claim 15, wherein the deflectable tab includes a fixed end at a stem of the respective conductor and a free end that is spaced apart from the stem, the fixed end being more proximate to the mating end of the housing stack than a proximity of the free end to the mating end.

18. The electrical connector of claim 15, wherein the housing stack extends along a stack axis between the mating end and the mounting end, the forward-facing shoulder of the front housing and the rear-facing shoulder of the rear housing that are associated with the same cavity being disposed axially between the first and second projecting features of the respective conductor within the cavity.

19. The electrical connector of claim 15, wherein the second projecting feature is a cantilevered beam that extends from a stem of the respective conductor, the cantilevered beam extending at an angle relative to the stem such that a free end of the cantilevered beam is more proximate to the mating end of the housing stack than a proximity of a fixed end of the cantilevered beam to the mating end, the free end of the cantilevered beam defining a hard stop surface that engages the rear-facing shoulder associated with the corresponding cavity.

20. The electrical connector of claim 15, wherein the conductors have planar stems that extend across an interface defined between the front housing and the rear housing, the first and second projecting features of the corresponding conductors both extending from the respective stem out of a plane defined by the stem, the first and second projecting features extending from opposite sides of the planar stems.

* * * * *